US006226892B1

(12) United States Patent
Bloecker et al.

(10) Patent No.: US 6,226,892 B1
(45) Date of Patent: May 8, 2001

(54) DRYING MODULE

(75) Inventors: Helmut Bloecker; Gerhard Kauer, both of Braunschweig (DE)

(73) Assignee: Gesellschaft fuer Biotechnologische Forschung mbH (GBF), Braunschweig (DE)

( * ) Notice: Subject to any disclaimer, the term of this patent is extended or adjusted under 35 U.S.C. 154(b) by 0 days.

(21) Appl. No.: 09/446,497

(22) PCT Filed: Jul. 3, 1998

(86) PCT No.: PCT/EP98/04121

§ 371 Date: May 2, 2000

§ 102(e) Date: May 2, 2000

(87) PCT Pub. No.: WO99/01708

PCT Pub. Date: Jan. 14, 1999

(30) Foreign Application Priority Data

Jul. 3, 1997 (DE) ..... 197 28 496

(51) Int. Cl.[7] ..... F26B 13/10

(52) U.S. Cl. ..... 34/527; 34/546; 34/572; 34/107; 34/197

(58) Field of Search ..... 34/527, 546, 572, 34/90, 106, 107, 195, 197; 427/372.2, 378; 430/350, 351, 379

(56) References Cited

U.S. PATENT DOCUMENTS

| | | | | |
|---|---|---|---|---|
| 5,451,524 | * | 9/1995 | Coble et al. | 34/192 X |
| 5,498,394 | * | 3/1996 | Matschke | 34/572 X |
| 5,572,802 | * | 11/1996 | Alpenfels et al. | 34/192 |
| 5,704,135 | * | 1/1998 | Riahi | 34/562 X |
| 5,755,039 | * | 5/1998 | Mae et al. | 34/197 X |
| 5,970,625 | * | 10/1999 | Scheufler et al. | 34/477 |
| 6,068,874 | * | 5/2000 | Grocholski et al. | 34/197 |

* cited by examiner

*Primary Examiner*—Stephen Gravini
(74) *Attorney, Agent, or Firm*—Pitney, Hardin, Kipp & Szuch, LLP

(57) ABSTRACT

A dryer module for drying filter supports in DNA preparation comprises a receiving member for receiving the filter support and at least one blower member, the blower member being arranged below the receiving member for receiving the filter support so that the filter support is blown on an dried from below. The dryer module also has a heating system for warming the air blown from below against the filter support, the heating system being arranged above the blower member, of which there is at least one. The dryer module is electronically controlled by a control means as a function of the measured temperature of the drying air. The dryer module can be used as a stand-along apparatus or in an automated environment.

10 Claims, 4 Drawing Sheets

DRYING MODULE

Figure 1:
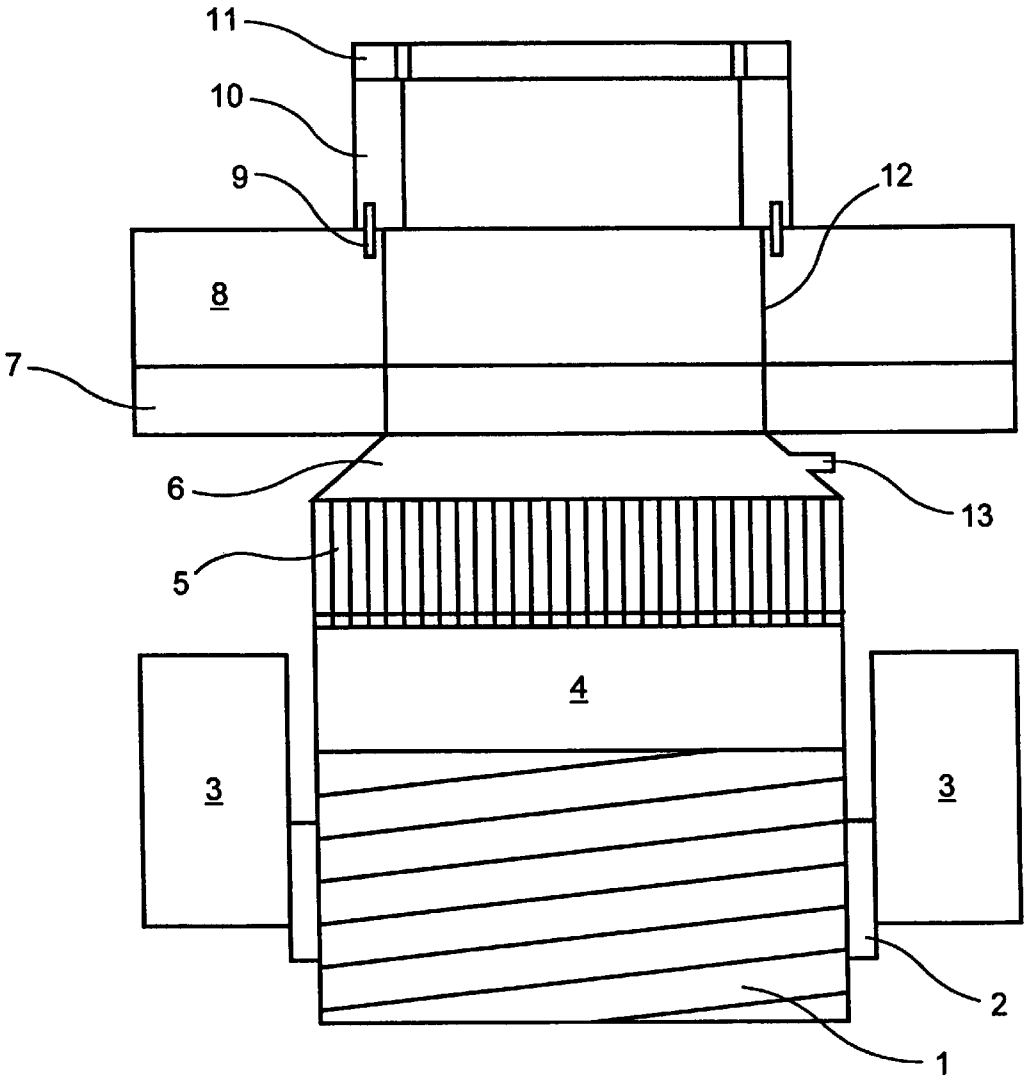

The invention relates to a dryer module for drying filter supports, as used in DNA preparation.

In modern DNA preparation procedures, the products of which are to be used in sequencing tasks, it is becoming clear, especially in the case of the more recent megasequencing projects (Human Genome Project), that automation of the labour-intensive manual steps is indispensable. Whereas previously so-called "ready-to-use kits" that simplified the working up of DNA sequences introduced by cloning were not available, today there are already a few commercially available aids in existence that are also suitable for automatically working through the corresponding protocols (such as, for example, the widespread Qiagen protocol) using robots.

The preparation protocol described by Qiagen comprises washing with ethanol-containing buffer the DNA adsorbed on filter elements of a filter support. Experiments have shown that traces of ethanol have a severely adverse effect on the result of the subsequent sequencing reactions. The participating enzymes are probably inhibited by ethanol. In this step, initially the larger amounts of ethanol are removed from the filters in known manner. When the protocol is carried out, for example, in an appropriate vacuum apparatus, the removal can be achieved by the vacuum being applied for longer than would be necessary for the purpose of removing the washing liquid. The air flow generated in the filter in that manner removes the larger amounts of ethanol from the filters, but the particular construction of the Qiagen filter supports causes contamination of the subsequent sequencing process if no special precautions are taken, since residues of ethanol remain on the walls between the outlet nozzles and the plastics housings on the underside of the filter support. Contamination by ethanol was also observed during the elution of the DNA from the filter material, the contamination occurring as follows: as the eluate is being sucked off into the eluate collectors, a drop forms on the outlet nozzle. Before that drop is drawn off it "migrates" upwards on the nozzles and comes into contact with the ethanol-containing liquid still to be found there. Mixing consequently occurs. The drop is then drawn off and falls into the eluate collector. The result is a general contamination of the eluate with ethanol to such an extent that the sequencing batch is "poisoned".

The problem underlying the invention is therefore to provide an apparatus by which the remaining residual alcohol is removed from filter supports, as used, for example, in the Qiagen protocol.

This problem is solved by the features of claim 1. The subsidiary claims relate to advantageous configurations of the invention.

The invention relates to a dryer module for drying filter supports in DNA preparation, wherein the dryer module has a receiving member for receiving the filter support, and at least one blower member, the blower member being arranged below the receiving member for receiving the filter support so that the filter support is blown on and dried from below.

Preferably, the dryer module according to the invention has at least one heating element for warming the air blown from below against the filter support.

Furthermore, an air shaft for guiding the drying air is arranged between the blower and the receiving member for the filter support, in which air shaft the heating elements are arranged.

Advantageously, the blower member is formed by a crossflow blower which is driven by an electric motor.

Furthermore, the upper end of the air shaft can be formed as a nozzle for channeling the lateral air flow.

Advantageously, the receiving member for the filter support is formed as a centring plate, the centring plate being arranged on foot members so that the centring plate, together with the foot members, forms a filter support stand.

Also, the dryer module can be arranged in an opening in a bench top. The dryer module can, however, also be operated as an individual piece of apparatus, either in an automated environment or as a stand-alone apparatus.

Advantageously, the step of removing the ethanol from the region between the outlet nozzle and the plastics housing of the filter support is not carried out manually but is automated. For that purpose, the dryer module blows warmed air (50° C. maximum) from below against the filter support and evaporates the ethanol. The filter dried in that way is introduced into a vacuum chamber again in order to be aerated once more for a certain time by the application of a vacuum. In that second step, remaining traces of ethanol are further removed. Finally, the filter treated in that way is again placed on the dryer module so as to ensure, by means of the heated air flow, that any possible traces of ethanol still present are finally evaporated off. Only then is the filter support, for example, reinserted into the pipetting robot in order for the eluant to be pipetted in for the purpose of releasing the DNA from the filters.

Figure 2:
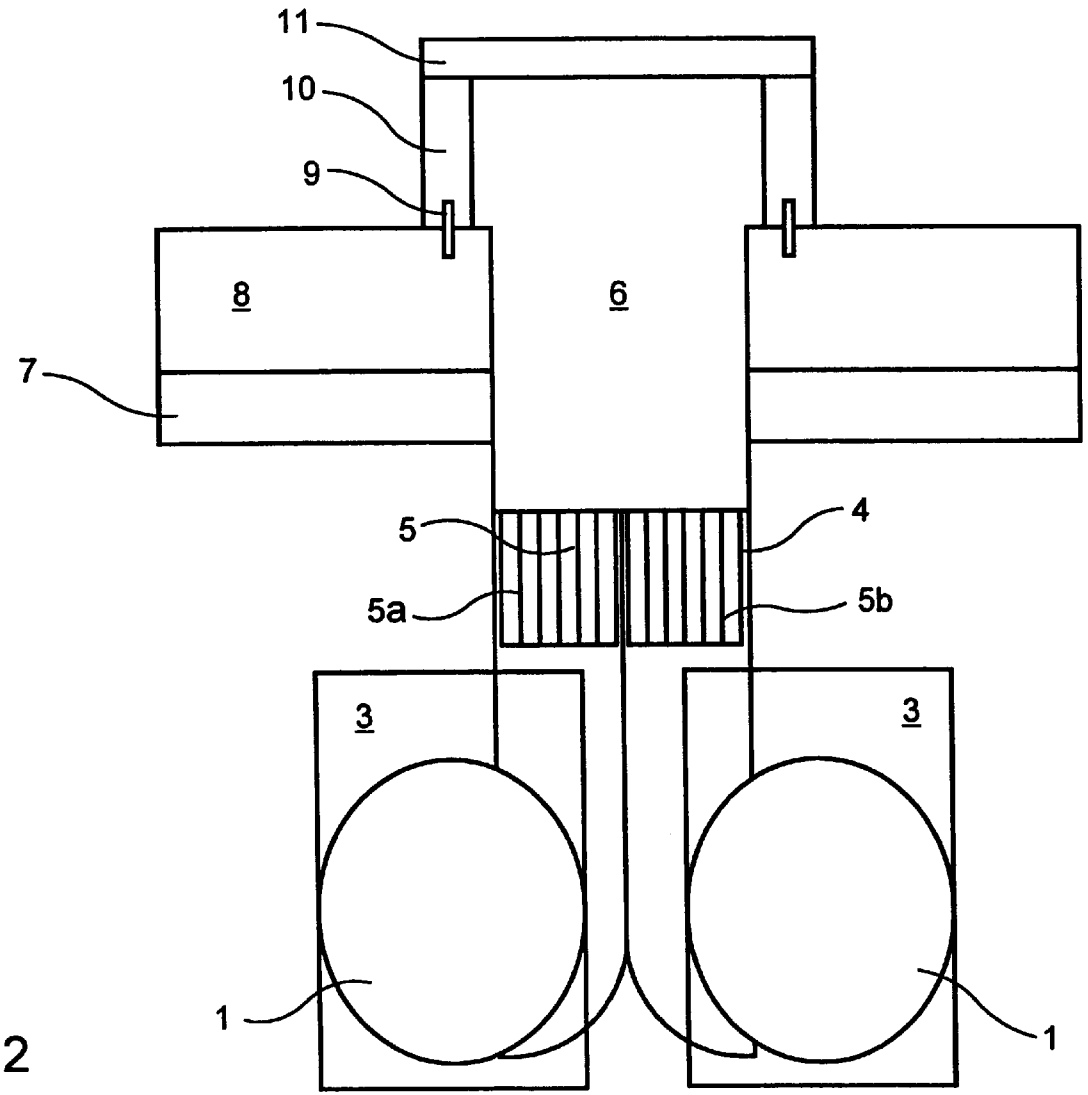
Figure 3:
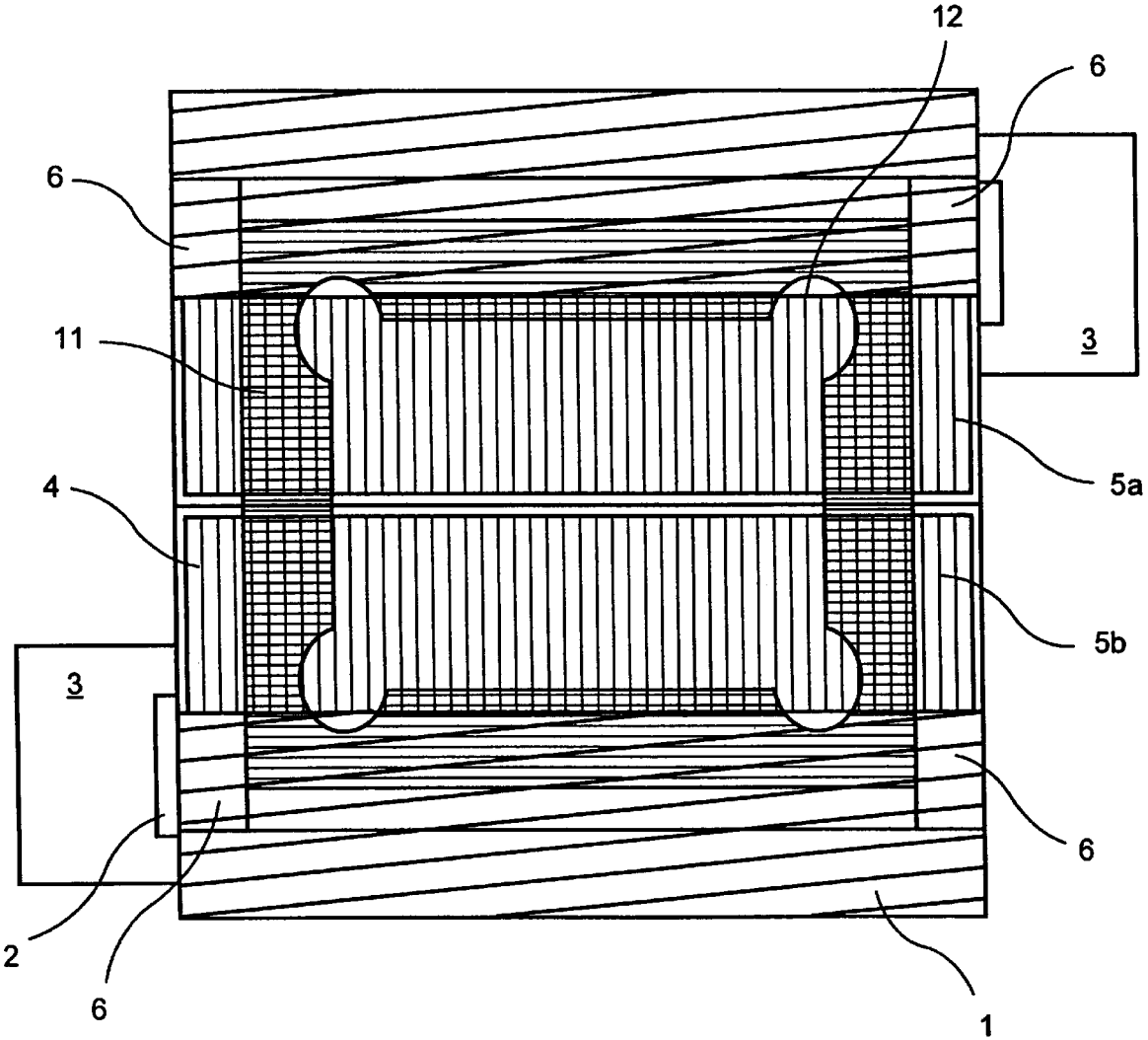
Figure 4:
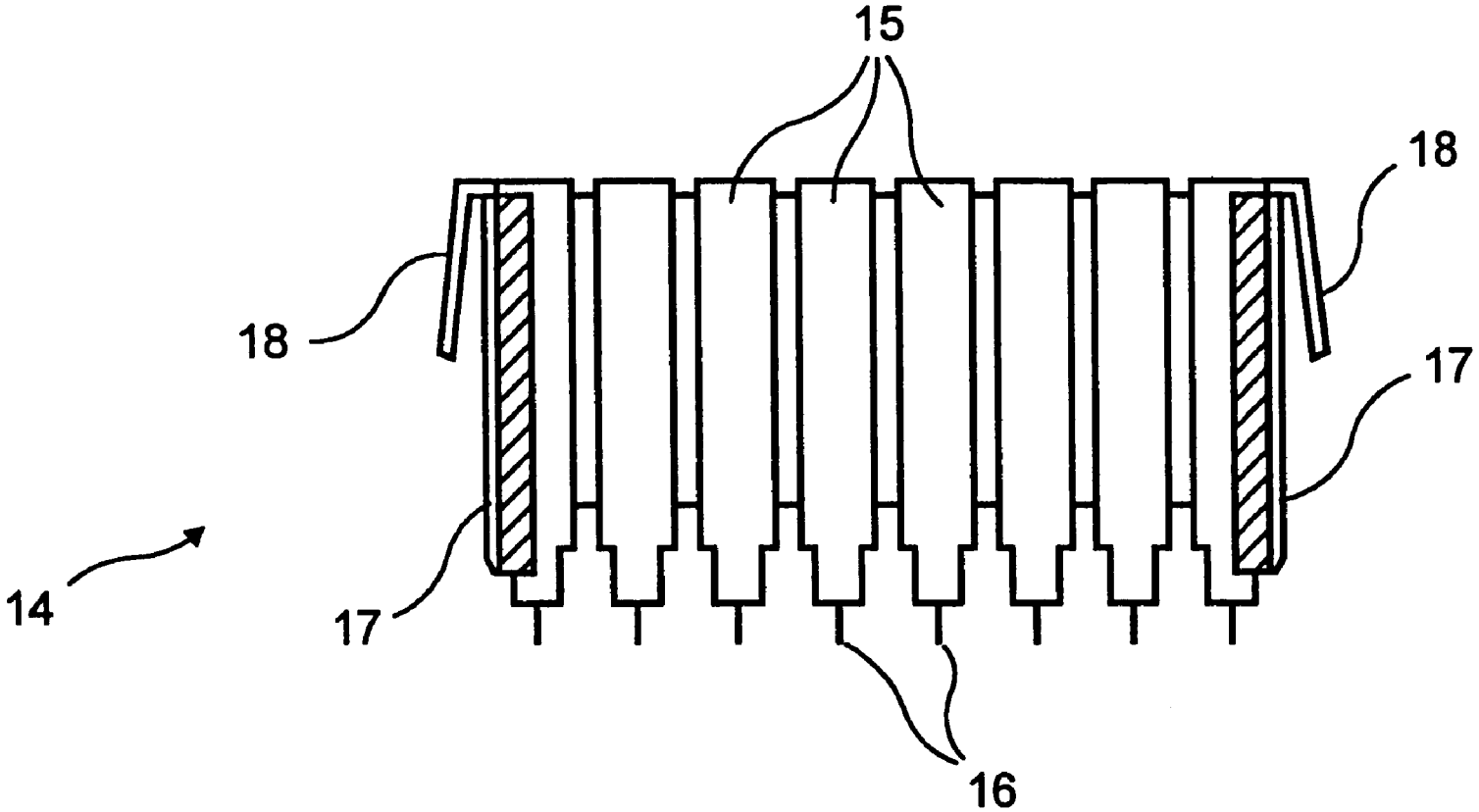

A preferred embodiment of the invention is described in the following with reference to the drawings in which FIG. 1 is a diagrammatic cross-section through a dryer module fixed in a bench top, FIG. 2 is a cross-section of the dryer module rotated through 90° relative to the view in FIG. 1, FIG. 3 is a view of the dryer module according to the invention from below, and FIG. 4 is a cross-section of a filter support employed.

In the preferred embodiment shown in FIG. 1, two crossflow blowers 1 are coupled along their longitudinal sides in order to achieve an air flow that is as far as possible homogeneous. A uniform air flow is thus generated over the entire face of the filter support (not showing) to be dried. The outlet surface area of the air shaft 4, which in the preferred embodiment is 8 cm×12.5 cm, is somewhat larger than the base surface area of the filter support to be dried. The air flow is 2×80 $m^3$/h maximum and can be regulated, by means of a transformer (not shown) connected upstream, by way of the rotational speed of the motors 3 of the pair of crossflow blowers 1.

The rectangular air shaft 4 is so constructed that the air flow is channeled identically to a nozzle 6 toward the outlet opening. It is made of 2 mm-thick sheet iron and soldered together to form a closed shape. Arranged in the lower region thereof is a receiver for a heating system 5, below which the two crossflow blowers 1 are secured. The upper portion of the air shaft 4 is fastened in a correspondingly dimensioned opening in a bench top 7 and thus fixed at a precisely defined position in the work area. The heating elements 5*a*, 5*b* and the blower members 1 are as a result of this arrangement located below the workbench 7. The opening of the air shaft 4 is preferably at the same level as the working surface of a robot bench (not shown) in cases where the dryer module is used in an automated process.

In the preferred embodiment, the heating system 5 consists of two heating elements 5*a*, 5*b*, as will become clearer in FIGS. 2 and 3. The heating elements 5*a*, 5*b* are fixed across the outlet opening of the crossflow blowers 1. In each case two mica multi-perforated plates are used as supports for a heating wire, which is mounted in the air flow in the form of coils spaced approximately 3 mm apart and thus heats the air flow uniformly. The coils are so created that the reverse loop comes to lie outside the air flow, while the heating wires, which extend in parallel, are arranged at right angles to the mica multi-perforated plates.

The filter stand, consisting of a receiving member 11 and supporting members 10, is so designed that it has centring members (shown in FIG. 3) at its contact points with the filter support (not shown). 30° bevels in the regions where the spacer sleeves (see FIG. 4) come into contact with a filter support are to be given special mention. In the preferred embodiment, the filter stand comprises an upper supporting plate or centring plate 10 acting as a receiving member, which has centring members, that is to say recesses for the spacer sleeves and the bearing face for the edge of the filter support. Fixed to that centring plate at the four corner points are 4.5 cm-high supporting members 10, the lower ends of which each have a fastening bolt 8 measuring 0.3 cm. Those bolts 9 fix the filter support stand exactly above the air outlet shaft 4 of the dryer module by engaging in corresponding bores in a plate 8, which is arranged on the workbench, in order to fasten the stand. In the preferred embodiment, the plate 8 is made of acrylic material. Once the filter support, which is illustrated in FIG. 4, has been inserted, the outlet nozzles thereof are located approximately 3 cm above the upper edge of the air shaft 4.

The control of the blower members 1 and the control of the heating elements 5*a*, 5*b* are carried out separately by a controller interface. It is thus possible for the heating system 5 to be switched off first after the drying operation is complete, so that the blowing, which is then having a cooling effect on the heating wires, is terminated after a time delay. In order for the temperature to be measured, a lateral recess 13 is provided in the nozzle 6 for receiving a temperature sensor. The heating elements 5*a*, 5*b* are controlled by a temperature threshold circuit.

FIG. 2 is also a cross-section of the dryer module according to the invention, but the cross-section is rotated through 90° about the vertical axis of symmetry in relation to the view in FIG. 1. It is possible to see the two parallel crossflow blower barrels 1, which are driven by corresponding motors 3. The two heating elements 5*a*, 5*b* of the heating system 5 are arranged in parallel and virtually abutting one another in the air shaft 4. Above the heating elements, the nozzle 6 is formed as a component of the shaft 4 for the purpose of channeling the drying air. In the embodiment shown here, the dryer module is fastened in the opening of a bench top 7 or similar. Arranged on the bench top 7 is a plate 8, preferably made of acrylic material or a similar material, which carries the filter support stand consisting of the supporting members 9 and the centring plate 11, the filter support stand being fixed and aligned in the plate 8 by means of fastening bolts 9.

FIG. 3 shows the above-described dryer module from above. Referring to FIG. 3, it should be taken into account that, in the preferred embodiment, the plate 8 consists of acrylic material and is therefore transparent. Illustrated are two crossflow blowers 1 with drive connections 2 and motors 3, and the heating elements 5*a* and 5*b* in the air shaft 4, which forms a nozzle 6. The centring plate 11 has four centring shafts 12 for receiving correspondingly shaped spacer sleeves of the filter support, which sleeves are shown in FIG. 4. The centring shafts 12 enforce the alignment of the filter support.

For the purpose of illustration, FIG. 4 shows a cross-section through a filter support 14 as normally used, which is formed by a plurality of filter elements 15 connected to one another in known manner. Usually, the filter support is of rectangular shape in plan view. The outer filter elements 15 of the filter support 14 have spacer sleeves 17, which are used to centre the filter support 14 in an automated environment. In the case illustrated, they are used for the purpose of centring in the centring shafts 12 of the centring plate 11. The filter support 14 also has a circumferential wall 18 in the shape of a crown. When the filter support is being inserted into the centring plate 11 of the dryer module, first of all the spacer sleeves 17 engage in the centring shafts 12, and the filter support 14 is moved downwards, for example by a robot, until the wall 18 sits on the centring plate 11 and the filter support 14 thus adopts its final position. The dryer module is then ready for operation.

| List of Reference Numerals | |
|---|---|
| 1 | crossflow blower barrels |
| 2 | drive connection |
| 3 | motor |
| 4 | air shaft |
| 5 | heating system |
| 5a, 5b | heating element |
| 6 | nozzle |
| 7 | bench top |
| 8 | acrylic plate |
| 9 | fastening bolts |
| 10 | stand |
| 11 | centring plate |
| 12 | centring shaft |
| 13 | temperature sensor receiver |
| 14 | filter support |
| 15 | filter element |
| 16 | filter element nozzle |
| 17 | spacer sleeve |
| 18 | wall |

What is claimed is:

1. Dryer module for drying a filter support (14) in the context of DNA preparation, having a heating system (5) and a blower member (1), the heating system (5) being arranged downstream of the blower member (1) and a filter (15) arranged in a filter support (14) being blown on and dried from below, wherein the filters (15) are arranged suspended in the filter support (14) and the filter support has spacer sleeves (17) that are insertable into corresponding centring shafts (12) in a centring plate (11) for receiving the filter support (14), the heating system (5) comprising heating wires, which extend in parallel over a rectangular cross-section of an air shaft (4) and which are arranged at right angles to the air flow and upstream of the centring plate (11), and the dryer module having a crossflow blower as blower member (1).

2. Dryer module according to claim 1, wherein the blower member (1) is driven by an electric motor (3).

3. Dryer module according to claim 1, wherein a nozzle (6) for channeling the air flow is arranged between the air shaft (4) and the centring member (11) for the filter support (14).

4. Dryer module according to claim 1, wherein the dryer module is arranged in an opening in a bench top (7).

5. Dryer module according to claim 1, wherein the centring plate (11) for receiving the filter support is arranged on supporting members (10).

6. Dryer module according to claim 2, wherein the module has a temperature sensor.

7. Dryer module according to claim 6, wherein the module has an electrical control means for controlling the motor (3), of which there is at least one, and the heating system (5), the heating system being controlled as a function of the temperature measured by the temperature sensor.

8. Dryer module according to claim 7, wherein the control means is provided with a delay circuit which, when the dryer module is switched off, causes the blower member (1), of which there is at least one, to be switched off chronologically after the heating system (5) is switched off.

9. Use of the dryer module according to claim 1 in an automated environment.

10. Use of the dryer module according to claim 1 as a stand-alone apparatus.

* * * * *